US007699698B2

(12) United States Patent
Randall

(10) Patent No.: US 7,699,698 B2
(45) Date of Patent: Apr. 20, 2010

(54) GAMING MACHINE AND METHOD INVOLVING A SELECTABLE BONUS EVALUATION SYSTEM

(75) Inventor: Dov Liam Randall, Las Vegas, NV (US)

(73) Assignee: IGT, Reno, NV (US)

( * ) Notice: Subject to any disclaimer, the term of this patent is extended or adjusted under 35 U.S.C. 154(b) by 965 days.

(21) Appl. No.: 10/861,084

(22) Filed: Jun. 3, 2004

(65) Prior Publication Data

US 2004/0259625 A1 Dec. 23, 2004

(30) Foreign Application Priority Data

Jun. 6, 2003 (GB) ..... 0313010.1

(51) Int. Cl.
*G07F 17/34* (2006.01)

(52) U.S. Cl. ..... 463/20; 463/16; 463/40

(58) Field of Classification Search ..... 463/20, 463/16, 40–42

See application file for complete search history.

(56) References Cited

U.S. PATENT DOCUMENTS

| | | | |
|---|---|---|---|
| 1,978,395 | A | 4/1934 | Groetchen |
| 2,545,644 | A | 3/1951 | Benton et al. |
| 3,420,525 | A | 1/1969 | Waders |
| 3,642,287 | A | 2/1972 | Lally et al. |
| 3,735,987 | A | 5/1973 | Ohki |
| 3,975,022 | A | 8/1976 | Figueroa |
| 4,258,838 | A | 3/1981 | Rockola et al. |
| 4,326,351 | A | 4/1982 | Heywood et al. |
| 4,410,178 | A | 10/1983 | Partridge |
| 4,448,419 | A | 5/1984 | Telnaes |
| 4,517,558 | A | 5/1985 | Davids |
| 4,582,324 | A | 4/1986 | Koza et al. |
| 4,624,459 | A | 11/1986 | Kaufman |
| 4,669,731 | A | 6/1987 | Clarke |
| 4,695,053 | A | 9/1987 | Vazquez, Jr. et al. |
| 4,732,386 | A | 3/1988 | Rayfiel |
| 4,756,531 | A | 7/1988 | DiRe et al. |
| 4,805,907 | A | 2/1989 | Haiwara |

(Continued)

FOREIGN PATENT DOCUMENTS

| | | |
|---|---|---|
| AU | 758306 | 8/1998 |

(Continued)

OTHER PUBLICATIONS

3RV—Jackpot Party Advertisement written by WMS Gaming, Inc., published Aug. 8, 2002.

(Continued)

*Primary Examiner*—Peter DungBa Vo
*Assistant Examiner*—Masud Ahmed
(74) *Attorney, Agent, or Firm*—K&L Gates LLP

(57) ABSTRACT

A coin-operated player operable entertainment machine has a main display device, such as rotatable symbol-bearing reels, which selects a combination of symbols at a win zone after a game-play stake has been credited. Some symbols are bonus symbols which can initiate a bonus feature if at predetermined win zone positions. The game-play stake can be changed by the player to change options for attaining the bonus feature. The arrangement may be such that an increase in stake value results in an increase in the number of predetermined positions which correspond to initiation of the bonus feature.

26 Claims, 2 Drawing Sheets

U.S. PATENT DOCUMENTS

| | | | |
|---|---|---|---|
| 4,836,553 | A | 6/1989 | Suttle et al. |
| 4,861,041 | A | 8/1989 | Jones et al. |
| 4,871,171 | A | 10/1989 | Rivero |
| 4,978,129 | A | 12/1990 | Komeda et al. |
| 4,991,848 | A | 2/1991 | Greenwood et al. |
| 5,019,973 | A | 5/1991 | Wilcox et al. |
| 5,033,744 | A | 7/1991 | Bridgeman et al. |
| 5,058,893 | A | 10/1991 | Bertram et al. |
| 5,092,598 | A | 3/1992 | Kamille |
| 5,098,107 | A | 3/1992 | Boylan et al. |
| 5,116,055 | A | 5/1992 | Tracy |
| 5,123,649 | A | 6/1992 | Tiberio |
| 5,152,529 | A | 10/1992 | Okada |
| 5,167,413 | A | 12/1992 | Fulton |
| 5,178,390 | A | 1/1993 | Okada |
| 5,205,555 | A | 4/1993 | Hamamo |
| 5,249,800 | A | 10/1993 | Hilgendorf et al. |
| 5,259,616 | A | 11/1993 | Bergmann |
| 5,280,909 | A | 1/1994 | Tracy |
| 5,286,023 | A | 2/1994 | Wood |
| 5,288,077 | A | 2/1994 | Jones |
| 5,288,081 | A | 2/1994 | Breeding |
| 5,332,219 | A | 7/1994 | Marnell, II et al. |
| 5,342,047 | A | 8/1994 | Heidel et al. |
| 5,342,049 | A | 8/1994 | Wichinsky et al. |
| 5,344,144 | A | 9/1994 | Canon |
| 5,362,052 | A | 11/1994 | Kubatsch |
| 5,364,100 | A | 11/1994 | Ludlow et al. |
| 5,364,105 | A | 11/1994 | Jones |
| 5,377,973 | A | 1/1995 | Jones et al. |
| 5,380,007 | A | 1/1995 | Travis et al. |
| 5,393,057 | A | 2/1995 | Marnell, II |
| 5,393,061 | A | 2/1995 | Manship et al. |
| 5,395,111 | A | 3/1995 | Inoue |
| 5,397,125 | A | 3/1995 | Adams |
| 5,407,200 | A | 4/1995 | Zalabak |
| 5,431,407 | A | 7/1995 | Hofberg et al. |
| 5,437,462 | A | 8/1995 | Breeding |
| 5,449,173 | A | 9/1995 | Thomas et al. |
| 5,452,899 | A | 9/1995 | Skratulia et al. |
| 5,456,465 | A | 10/1995 | Durham |
| 5,490,670 | A | 2/1996 | Hobert |
| 5,494,287 | A | 2/1996 | Manz |
| 5,511,781 | A | 4/1996 | Wood et al. |
| 5,524,888 | A | 6/1996 | Heidel |
| 5,529,309 | A | 6/1996 | Bartlett |
| 5,531,440 | A | 7/1996 | Dabrowski et al. |
| 5,531,441 | A | 7/1996 | Dabrowski et al. |
| 5,536,016 | A | 7/1996 | Thompson |
| 5,542,669 | A | 8/1996 | Charron et al. |
| 5,551,692 | A | 9/1996 | Pettit et al. |
| 5,560,603 | A | 10/1996 | Seelig et al. |
| 5,577,731 | A | 11/1996 | Jones |
| 5,584,485 | A | 12/1996 | Jones et al. |
| 5,584,763 | A | 12/1996 | Kelly et al. |
| 5,584,764 | A | 12/1996 | Inoue |
| 5,607,162 | A | 3/1997 | Boylan et al. |
| 5,609,524 | A | 3/1997 | Inoue |
| 5,611,535 | A | 3/1997 | Tiberio |
| 5,611,730 | A | 3/1997 | Weiss |
| 5,626,341 | A | 5/1997 | Jones et al. |
| 5,645,485 | A | 7/1997 | Clapper, Jr. |
| 5,645,486 | A | 7/1997 | Nagao et al. |
| 5,647,798 | A | 7/1997 | Falciglia |
| 5,660,391 | A | 8/1997 | Klasee |
| 5,660,393 | A | 8/1997 | Dreger |
| 5,664,781 | A | 9/1997 | Feola |
| 5,664,998 | A | 9/1997 | Seelig et al. |
| 5,709,603 | A | 1/1998 | Kaye |
| 5,711,525 | A | 1/1998 | Breeding |
| 5,722,891 | A | 3/1998 | Inoue |
| 5,732,948 | A | 3/1998 | Yoseloff |
| 5,743,524 | A | 4/1998 | Nannicola |
| 5,752,881 | A | 5/1998 | Inoue |
| 5,766,074 | A | 6/1998 | Cannon et al. |
| 5,769,716 | A | 6/1998 | Saffari et al. |
| 5,772,509 | A | 6/1998 | Weiss |
| 5,775,692 | A | 7/1998 | Watts et al. |
| 5,788,573 | A | 8/1998 | Baerlocher et al. |
| 5,794,964 | A | 8/1998 | Jones et al. |
| 5,795,225 | A | 8/1998 | Jones et al. |
| 5,807,172 | A | 9/1998 | Piechowiak |
| 5,817,172 | A | 10/1998 | Yamada et al. |
| 5,823,872 | A | 10/1998 | Prather et al. |
| 5,823,874 | A | 10/1998 | Adams et al. |
| D400,597 | S | 11/1998 | Hedrick et al. |
| 5,833,538 | A | 11/1998 | Weiss |
| D402,702 | S | 12/1998 | Seelig et al. |
| 5,848,932 | A | 12/1998 | Adams |
| 5,855,514 | A | 1/1999 | Kamille |
| 5,863,249 | A | 1/1999 | Inoue |
| 5,873,781 | A | 2/1999 | Keane |
| D406,865 | S | 3/1999 | Heidel |
| 5,882,261 | A | 3/1999 | Adams |
| 5,885,157 | A | 3/1999 | Harada et al. |
| 5,885,158 | A | 3/1999 | Torango et al. |
| 5,902,184 | A | 5/1999 | Bennett |
| 5,910,048 | A | 6/1999 | Feinberg |
| 5,911,418 | A | 6/1999 | Adams et al. |
| 5,919,088 | A | 7/1999 | Weiss |
| 5,927,714 | A | 7/1999 | Kaplan |
| 5,935,002 | A | 8/1999 | Falciglia |
| 5,941,773 | A | 8/1999 | Harlick |
| 5,947,820 | A | 9/1999 | Morro et al. |
| 5,951,397 | A | 9/1999 | Dickinson |
| 5,964,463 | A | 10/1999 | Moore, Jr. |
| 5,967,893 | A | 10/1999 | Lawrence et al. |
| 5,967,894 | A | 10/1999 | Kinoshita et al. |
| 5,976,015 | A | 11/1999 | Seelig et al. |
| 5,980,384 | A | 11/1999 | Barrie |
| 5,984,781 | A | 11/1999 | Sunaga |
| 5,984,782 | A | 11/1999 | Inoue |
| 5,993,316 | A | 11/1999 | Coyle et al. |
| 5,996,997 | A | 12/1999 | Kamille |
| 5,997,400 | A | 12/1999 | Seelig et al. |
| 5,997,401 | A | 12/1999 | Crawford |
| 6,004,207 | A | 12/1999 | Wilson, Jr. et al. |
| 6,012,982 | A | 1/2000 | Piechowiak et al. |
| 6,012,983 | A | 1/2000 | Walker et al. |
| 6,015,346 | A | 1/2000 | Bennett |
| 6,019,369 | A | 2/2000 | Nakagawa et al. |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,086,066 | A | 7/2000 | Takeuchi et al. |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,102,400 | A | 8/2000 | Scott et al. |
| 6,102,798 | A | 8/2000 | Bennett |
| 6,105,962 | A | 8/2000 | Malavazos et al. |
| 6,110,041 | A | 8/2000 | Walker et al. |
| 6,110,043 | A | 8/2000 | Olsen |
| 6,113,098 | A | 9/2000 | Adams |
| 6,117,009 | A | 9/2000 | Yoseloff |
| 6,117,012 | A | 9/2000 | McCrea, Jr. |
| 6,120,031 | A | 9/2000 | Adams |
| 6,126,542 | A | 10/2000 | Fier |
| 6,129,632 | A | 10/2000 | Luciano |
| 6,135,884 | A | 10/2000 | Hedrick et al. |
| 6,142,873 | A | 11/2000 | Weiss et al. |

6,142,874 A 11/2000 Kodachi et al.
6,146,273 A 11/2000 Olsen
6,155,925 A * 12/2000 Giobbi et al. ..... 463/20
6,158,741 A 12/2000 Koelling
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,162,122 A 12/2000 Acres et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,234 B1 1/2001 Seibert et al.
6,174,235 B1 1/2001 Walker et al.
6,179,711 B1 1/2001 Yoseloff
6,186,894 B1 2/2001 Mayeroff
6,190,254 B1 2/2001 Bennett
6,203,429 B1 3/2001 Demar et al.
D441,031 S 4/2001 Seelig et al.
6,210,277 B1 4/2001 Stefan
6,210,279 B1 4/2001 Dickinson
6,213,876 B1 4/2001 Moore, Jr.
6,220,593 B1 4/2001 Pierce et al.
6,224,482 B1 5/2001 Bennett
6,224,483 B1 * 5/2001 Mayeroff ..... 463/20
6,227,969 B1 5/2001 Yoseloff
6,227,970 B1 5/2001 Shimizu et al.
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,238,288 B1 5/2001 Walker et al.
D443,313 S 6/2001 Brettschneider
6,241,608 B1 6/2001 Torango
6,244,957 B1 6/2001 Walker et al.
6,251,013 B1 6/2001 Bennett
6,254,481 B1 7/2001 Jaffe
6,254,482 B1 7/2001 Walker et al.
6,261,177 B1 7/2001 Bennett
6,267,669 B1 7/2001 Luciano, Jr. et al.
6,270,409 B1 8/2001 Shuster
6,270,411 B1 8/2001 Gura et al.
6,270,412 B1 8/2001 Crawford
6,290,600 B1 9/2001 Glasson
6,296,568 B1 10/2001 Tracy
6,299,165 B1 10/2001 Nagano
6,302,790 B1 10/2001 Brossard
6,302,791 B1 10/2001 Frohm et al.
6,305,686 B1 10/2001 Perrie et al.
6,309,299 B1 10/2001 Weiss
6,309,300 B1 10/2001 Glavich
6,312,331 B1 11/2001 Tamaki
6,312,334 B1 11/2001 Yoseloff
6,315,662 B1 11/2001 Jorasch et al.
6,315,663 B1 11/2001 Sakamoto
6,315,664 B1 11/2001 Baerlocher et al.
6,319,124 B1 11/2001 Baerlocher
6,322,445 B1 11/2001 Miller
6,328,649 B1 12/2001 Randall et al.
6,334,612 B1 1/2002 Wurz et al.
6,334,814 B1 1/2002 Adams
6,336,860 B1 1/2002 Webb
6,336,862 B1 1/2002 Byrne
6,336,863 B1 1/2002 Baerlocher et al.
6,340,158 B2 1/2002 Pierce et al.
6,346,043 B1 2/2002 Colin et al.
6,347,996 B1 2/2002 Gilmore et al.
6,358,147 B1 * 3/2002 Jaffe et al. ..... 463/20
6,368,216 B1 4/2002 Hedrick et al.
6,375,187 B1 4/2002 Baerlocher
6,386,974 B1 5/2002 Adams
6,398,218 B1 6/2002 Vancura
6,398,220 B1 6/2002 Inoue
6,406,369 B1 6/2002 Baerlocher et al.
6,413,160 B1 7/2002 Vancura
6,413,161 B1 7/2002 Baerlocher et al.
6,416,408 B2 7/2002 Tracy et al.
6,419,579 B1 7/2002 Bennett et al.
6,428,412 B1 8/2002 Anderson et al.
6,435,511 B1 8/2002 Vancura et al.
6,435,968 B1 8/2002 Torango
6,439,995 B1 8/2002 Hughs-Baird et al.
6,454,266 B1 9/2002 Breeding et al.
6,454,651 B1 9/2002 Yoseloff
6,461,241 B1 10/2002 Webb et al.
6,471,208 B2 10/2002 Yoseloff et al.
D465,531 S 11/2002 Luciano, Jr. et al.
6,481,713 B2 11/2002 Perrie et al.
6,491,584 B2 12/2002 Graham et al.
6,494,785 B1 12/2002 Gerrard et al.
6,506,118 B1 1/2003 Baerlocher et al.
6,514,141 B1 2/2003 Kaminkow et al.
6,517,432 B1 2/2003 Jaffe
6,533,273 B2 3/2003 Cole et al.
6,533,660 B2 3/2003 Seelig et al.
6,537,152 B2 3/2003 Seelig et al.
6,544,120 B2 4/2003 Ainsworth
6,561,904 B2 5/2003 Locke et al.
6,569,015 B1 5/2003 Baerlocher et al.
6,575,830 B2 6/2003 Baerlocher et al.
6,582,307 B2 6/2003 Webb
6,585,591 B1 7/2003 Baerlocher et al.
6,589,114 B2 7/2003 Rose
6,592,460 B2 7/2003 Torango
6,595,854 B2 7/2003 Hughs-Baird et al.
6,599,185 B1 7/2003 Kaminkow et al.
6,599,192 B1 7/2003 Baerlocher et al.
6,599,193 B2 7/2003 Baerlocher et al.
6,602,137 B2 8/2003 Kaminkow et al.
6,607,437 B2 8/2003 Casey et al.
6,609,972 B2 8/2003 Seelig et al.
6,609,974 B2 8/2003 Mead et al.
6,612,574 B1 9/2003 Cole et al.
6,632,141 B2 10/2003 Webb et al.
6,638,164 B2 10/2003 Randall et al.
6,638,167 B1 10/2003 Sawyer et al.
6,659,864 B2 12/2003 McGahn et al.
6,669,561 B2 * 12/2003 Sunaga et al. ..... 463/20
6,682,073 B2 1/2004 Bryant et al.
6,712,694 B1 3/2004 Nordman
6,715,756 B2 4/2004 Inoue
6,719,630 B1 4/2004 Seelig et al.
6,726,204 B2 4/2004 Inoue
6,726,565 B2 4/2004 Hughs-Baird
D496,968 S 10/2004 Baerlocher
7,029,395 B1 * 4/2006 Baerlocher ..... 463/20
7,029,396 B2 * 4/2006 Jaffe et al. ..... 463/20
7,108,603 B2 9/2006 Olive
7,160,187 B2 1/2007 Loose et al.
7,329,179 B2 2/2008 Baerlocher
7,338,370 B2 * 3/2008 Oles et al. ..... 463/25
7,347,777 B2 * 3/2008 Gauselmann ..... 463/25
7,351,146 B2 4/2008 Kaminkow
7,374,486 B2 5/2008 Baerlocher
7,465,227 B2 12/2008 Baerlocher
7,470,185 B2 12/2008 Baerlocher
7,488,251 B2 2/2009 Kaminkow
7,507,156 B2 3/2009 Nicely
2001/0024971 A1 9/2001 Brossard
2001/0054794 A1 12/2001 Cole et al.
2002/0039920 A1 * 4/2002 Bryant ..... 463/20
2002/0042297 A1 4/2002 Torango

| | | | | |
|---|---|---|---|---|
| 2002/0094862 | A1 | 7/2002 | Inoue | |
| 2002/0142829 | A1 | 10/2002 | Inoue | |
| 2003/0027623 | A1 | 2/2003 | Rose | |
| 2003/0060266 | A1 | 3/2003 | Baerlocher | |
| 2003/0060279 | A1 | 3/2003 | Torango | |
| 2003/0083121 | A1 | 5/2003 | Cole et al. | |
| 2003/0087690 | A1 | 5/2003 | Loose et al. | |
| 2003/0144053 | A1 | 7/2003 | Michaelson | |
| 2003/0232643 | A1 | 12/2003 | Inoue | |
| 2004/0000754 | A1 | 1/2004 | Inoue | |
| 2004/0009811 | A1 | 1/2004 | Torango | |
| 2004/0012145 | A1 | 1/2004 | Inoue | |
| 2004/0014516 | A1 | 1/2004 | Inoue | |
| 2004/0014517 | A1 | 1/2004 | Inoue | |
| 2004/0017041 | A1 | 1/2004 | Inoue | |
| 2004/0018866 | A1 | 1/2004 | Inoue | |
| 2004/0026854 | A1 | 2/2004 | Inoue | |
| 2004/0036218 | A1 | 2/2004 | Inoue | |
| 2004/0038726 | A1 | 2/2004 | Inoue | |
| 2004/0041340 | A1 | 3/2004 | Inoue | |
| 2004/0043807 | A1* | 3/2004 | Pennington | 463/13 |
| 2004/0053660 | A1* | 3/2004 | Webb et al. | 463/16 |
| 2004/0063492 | A1 | 4/2004 | Baerlocher et al. | |
| 2004/0082373 | A1 | 4/2004 | Cole et al. | |
| 2004/0204218 | A1 | 10/2004 | Hughs-Baird | |
| 2004/0214630 | A1 | 10/2004 | Mayeroff | |
| 2005/0020348 | A1 | 1/2005 | Thomas et al. | |
| 2005/0054429 | A1 | 3/2005 | Baerlocher et al. | |
| 2005/0060050 | A1 | 3/2005 | Baerlocher | |
| 2005/0096123 | A1 | 5/2005 | Cregan et al. | |
| 2005/0119047 | A1 | 6/2005 | Olive | |
| 2005/0143168 | A1 | 6/2005 | Torango | |
| 2005/0176488 | A1 | 8/2005 | Olive | |
| 2005/0209004 | A1 | 9/2005 | Torango | |
| 2006/0019738 | A1 | 1/2006 | Baerlocher et al. | |
| 2006/0128457 | A1 | 6/2006 | Cannon | |
| 2006/0142077 | A1* | 6/2006 | Miles et al. | 463/20 |
| 2007/0054726 | A1 | 3/2007 | Muir et al. | |
| 2007/0060255 | A1 | 3/2007 | Baerlocher et al. | |
| 2008/0102934 | A1 | 5/2008 | Tan | |
| 2008/0108406 | A1 | 5/2008 | Oberberger | |
| 2008/0108408 | A1 | 5/2008 | Wolf | |
| 2008/0108425 | A1 | 5/2008 | Oberberger | |
| 2008/0113759 | A1 | 5/2008 | Baerlocher | |
| 2008/0132320 | A1 | 6/2008 | Rodgers | |
| 2008/0161097 | A1 | 7/2008 | Baerlocher et al. | |
| 2008/0182650 | A1 | 7/2008 | Randall et al. | |
| 2008/0182655 | A1 | 7/2008 | DeWaal et al. | |
| 2008/0194316 | A1 | 8/2008 | Baerlocher | |
| 2008/0214280 | A1 | 9/2008 | Baerlocher | |
| 2008/0214292 | A1 | 9/2008 | Bryant et al. | |
| 2008/0318668 | A1 | 12/2008 | Ching et al. | |
| 2009/0069073 | A1 | 3/2009 | Gerrard et al. | |

FOREIGN PATENT DOCUMENTS

| | | | |
|---|---|---|---|
| AU | 754689 | | 2/1999 |
| AU | 199884162 | | 3/1999 |
| EP | 912685 | | 12/1962 |
| EP | 1 003 138 | A | 5/2000 |
| GB | 2 201 821 | A | 9/1988 |
| GB | 2 328 311 | A | 2/1999 |
| GB | 2 335 066 | A | 9/1999 |
| WO | WO 85/00910 | | 2/1985 |
| WO | WO 00/32286 | | 6/2000 |
| WO | WO 01/15055 | | 3/2001 |
| WO | WO 01/15055 | A1 * | 3/2001 |

OTHER PUBLICATIONS

4DU Dice Unit Advertisement written by starpoint.uk.com, printed on Sep. 3, 2002.

American Bandstand Brochure, written by Anchor Games, published in 2001.

Austin Powers in Goldmember™ Advertisement, written by IGT, published in 2003.

Big Shot!™ Advertisement, published by Aristocrat Technologies, Inc., published in 2002.

Black Swan Wagering Advertisement and Paytable, written by IGT, published prior to 2001.

Bonus Roulette Brochure, written by R. Franco, published prior to 2004.

Buck's Roulette Brochure, written by R. Franco, published prior to 2004.

Chariot's of Fortune Brochure, written by R. Franco, published prior to 2004.

Classic Pot of Gold Brochure, written by Ace Coin Equipment Ltd., published prior to 2004.

Elvirae® Mistress of the Dark™ Advertisement, written by IGT, published in 2002.

Elvis Hits Advertisement, written by IGT, published in 1999.

Free Fall Poker Brochure, written by IGT, available prior to 2001.

Holy Smoke Brochure, written by Impulse Gaming Ltd., published prior to 2004.

Jack and the Beanstalk™ Brochure, written by AC Coin & Slot, published prior to 2004.

Jackpot Party Advertisements and Articles, written by WMS Gaming, Inc., published in Mar., 1998 (16 pages).

Jackpot Party How to Play printed from http://www.wmsgaming.com/products/video/vjpp/howto.html, printed on Feb. 7, 2001.

Jackpot Party Video 9-Line Advertisement, written by WMS Gaming, Inc., published prior to Sep. 11, 2003.

Jazzy Jackpots Advertisement, written by Atronic, published prior to 2001.

Jazzy Jackpots Article, written by Strictly Slots, published Mar. 2001.

King of the Grill™ Brochure, written by AC Coin & Slot, published prior to 2004.

Line-Up Brochure, written by AC Coin & Slot, published prior to 2004.

Little Green Men Jr.™ Article, written by Strictly Slots, published in Feb. 2003.

Magic 8 Ball Advertisement, written by IGT, published in 2002.

Miss America Brochure, written by AC Coin & Slot, published prior to 2004.

Mix and Match Advertisement, published by AC Coin & Slot, published prior to 2004.

Mix and Match Article, written by Strictly Slots, published in Apr. 2002.

Money Grab Article, written by Strictly Slots, published in Apr. 2001.

Monster Match Article, written by Strictly Slots, published in Jan. 2002.

Neon Nights Advertisement, written by IGT, published in 2000.

On the Money! Article, written by Strictly Slots, published in Dec. 2000.

Pick a Prize Brochure, written by Acres Gaming Incorporated, published prior 2001.

Power Slotto Brochure, published by AC Coin & Slot prior to 2002.

Press Your Luck Brochure, published by AC Coin & Slot prior to 2002.

Quick Pick Paytime Brochure, written by Acres Gaming Incorporated, published prior to 2001.

R&B™ Brochure, published by AC Coin & Slot, published prior to 2004.

Reel Dice Advertisement, written by Gerber & Glass, published in 1936.

Royal Roulette Brochure, written by Impulse Gaming Ltd., published prior to 2004.

Silver City Roundup Brochure, published by AC Coin & Slot, published prior to 2004.

Slot Machine Buyer's Handbook; A Consumer's Guide to Slot Machines written by David L. Saul and Daniel R. Mead, published in 1998.

Slot Machines a Pictorial History of the First 100 Years, 5$^{th}$ edition written by Marshall Fey, published in 1983-1997.

Slot Machines on Parade, 1$^{st}$ edition written by Robert N. Geddes and illustrated by Daniel R. Mead, published in 1980.

Spin-A-Lot Brochure, written by Acres Gaming Incorporated, published prior to 2001.
Take Your Pick Article, written by Strictly Slots, published in Mar. 2001.
Take Your Pick Brochure and Article, written by IGT/Anchor Games, Strictly Slots, published in 1999.
Tokenization Description, written by IGT, available prior to 2001.
Treasure Wheel/Treasure Tunnel Advertisemen,t written by Sigma Game, Inc., published prior to 2000.
Vision Bonus Game Advertisement, includes "Diamond Fives Buy-A-Bonus Spin", written by IGT, published 1999.
We Make Gaming Fun! Advertisement, written by WMS Gaming Inc., published prior to Sep. 11, 2003.
Wheel of Fortune Advertisement, written by IGT, published in 1998.
Wheel of Fortune Article, written by IGT, published in 1999.
Wheel of Fortune Paytable including progressive qualification, written by IGT, published in 2002.
Wild Streak Brochures, written by WMS Gaming Inc., published Mar. 2001.
Answer and Counterclaims of Defendants from Case No. 3:06-CV-03717—MJJ, *Aristocrat, et al.*. v. *International Game Technology and IGT*, filed Dec. 15, 2006 (pp. 24-29).
Documents related to Down-loaded System Awards Regulations, available prior to Aug. 2005 and submitted in Information Disclosure Statement dated Apr. 16, 2007 for U.S. Appl. Nos. 11/365,007, 11/365.
Documents related to the ACES game, available prior to Aug. 2005 and submitted in Information Disclosure Statements dated Apr. 16, 2007 for U.S. Appl. Nos. 11/365,007, 11/365,177, and 11/445,969.
Documents related to the Best-and-Fairest game, available prior to Aug. 2005 and submitted in Information Disclosure Statements dated Apr. 16, 2007 for U.S. Appl. Nos. 11/365,007, 11/365,177, and 11/445,969.
Documents related to the Cricketer game, available prior to Aug. 2005 and submitted in Information Disclosure Statements dated Apr. 16, 2007 for U.S. Appl. Nos. 11/365,007, 11/365,177, and 11/445,969.
Documents related to the Surprize (MV2030) game, available prior to Aug. 2005 and submitted in Information Disclosure Statements dated Apr. 16, 2007 for U.S. Appl. Nos. 11/365,007, 11/365,177, and 11/445,969.
Documents related to the Thrillions game, available prior to Aug. 2005 and submitted in Information Disclosure Statements dated Apr. 16, 2007 for U.S. Appl. Nos. 11/365,007, 11/365,177, and 11/445,969.
Fast Buck Systems Manual, written by International Game Technology, available to Mirage shift supervisors at least as early as May 30, 1990.
Fey, Marshall, Slot Machines, A Pictorial History of the First 100 Years, 1983, Liberty Bell Books, pp. 19, 43, 213.
Jackpot Bingo Description, Casino Data Systems (CDS.com), Printed on Apr. 12, 2001.
Megabucks Brochure, IGT, 1998.
Power Ball Lottery Odds and FAQ, http://www.musl.com, available at least as early as Jul. 11, 2002.
Slot Machines on Parade by Geddes et al., The Mead Company, 1980, pp. 127 & 192.
The Theory of Gambling and Statistical Logic by Epstein, 1977, pp. 117-118.
Vegas Girl Brochure, IGT, available prior to Oct. 13, 2000.
Video Wheel of Fortune Brochure, IGT, 1999.

* cited by examiner

GAMING MACHINE AND METHOD INVOLVING A SELECTABLE BONUS EVALUATION SYSTEM

PRIORITY CLAIM

This application claims priority to United Kingdom Patent Application No. GB 0313010.1, filed on Jun. 6, 2003, entitled "Entertainment Machines," the entire disclosure of which is incorporated herein.

CROSS REFERENCE TO RELATED APPLICATIONS

This application is related to the following commonly owned co-pending patent applications; U.S. Patent Application Publication No. 2003/0144053, published Jul. 31, 2003; U.S. Patent Application Publication No. 2004/0063492, published on Apr. 1, 2004; U.S. Patent Application Publication No. 2004/0204218, published on Oct. 14, 2004; U.S. Patent Application Publication No. 2005/0054429, published on Mar. 10, 2005; U.S. Patent Application Publication No. 2005/0060050, published on Mar. 17, 2005; U.S. Patent Application Publication No. 2005/0096123, published on May 5, 2005; U. S. Patent Application Publication No. 2006/0019738, published on Jan. 26, 2006; U.S. Patent Application Publication No. 2006/0128457, published on Jun. 15, 2006; U.S. Patent Application Publication No. 2007/0054726, published on Mar. 8, 2007; U.S. Patent Application Publication No. 2007/0060255, published on Mar. 15, 2007; U.S. Patent Application Publication No. 2008/0102934, published on May 1, 2008; U.S. Patent Application Publication No. 2008/0108406, published on May 8, 2008; U.S. Patent Application Publication No. 2008/0108408, published on May 8, 2008; U.S. Patent Application Publication No. 2008/0108425, published on May 8, 2008; U.S. Patent Application Publication No. 2008/0113759, published on May 15, 2008; U.S. Patent Application Publication No. 2008/0132320, published on Jun. 5, 2008; U.S. Patent Application Publication No. 2008/0161097, published on Jul. 3, 2008; U.S. Patent Application Publication No. 2008/0182650, published on Jul. 31, 2008; U.S. Patent Application Publication No. 2008/0182655, published on Jul. 31, 2008; U.S. Patent Application Publication No. 2008/0194316, published on Aug. 14, 2008; U.S. Patent Application Publication No. 2008/0214280, published on Sep. 4, 2008; U.S. Patent Application Publication No. 2008/0318668, published on Dec. 25, 2008; and U.S. Patent Application Publication No. 2009/0069073, published on Mar. 12, 2009.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

This invention relates to coin-operated player-operable entertainment machines, which may be gaming machines, such as so-called "fruit" or "poker" or "slot" machines, of the kind having a main display device operable, when actuated by a stake value, for play of a main game resulting in display of selected symbols at respective display positions at a win zone. As used herein, the term coin is intended also to cover tokens, charge or credit cards or any other means of supplying credit or monetary value.

The main display device of a gaming machine may comprise multiple side-by-side reels which are rotatable about a common horizontal axis within a housing behind a window at the win zone. Each reel has symbols equally spaced around its periphery and the reels can be brought to rest with one or more symbols on each reel displayed at the respective display positions in the window.

If the displayed combination of symbols at a predetermined combination of the display positions constitutes a predetermined winning combination an award may be made available to the player.

The reels may be actual mechanical reels in which case there are typically three or four reels with say three symbols on each reel displayed through the window, when the reel is at rest, one on a central horizontal win line and the other two respectively above and below this win line whereby a displayed winning symbol combination on display positions on this win line results in an award.

There may also be other win lines, horizontally above and below the central horizontal win line and/or vertically and/or diagonally whereby a displayed winning symbol combination on any of a selected combination of positions on any of a selected combination of such lines may result in an award.

The reels may be video simulated reels in which case it is feasible to provide more reel displays, say five reels, with more combinations of symbol positions used for win determination, say up to 20 or more position combinations.

BACKGROUND OF THE INVENTION

It is known to provide the player with the opportunity of selecting the range of combinations of symbol positions, or 'pay lines', to be used for win determination, an appropriate multiple of a basic stake value being required for multiple paylines.

It is also known to provide the player with the opportunity of multiplying the basic stake value so that any win attained is correspondingly multiplied. By way of example, with a basic stake value of say 5 cents and 20 paylines, the player may have the opportunity of wagering 5×20×5c=$5 to apply a 5 times multiple of the basic stake to all 20 symbol combinations.

It is also known to, provide special bonus symbols whereby on attaining a predetermined such symbol, or combination of such symbols, at a predetermined display position or positions, the player has the opportunity of transferring to a bonus feature which can result in a bonus award. Thus, for example, play may transfer to a separate mechanical bonus reel which rotates and comes to rest, or a wheel around which a pointer spins and then comes to rest, to indicate a selected bonus value printed on or alongside the reel or wheel.

With this arrangement, in the case where the player has the opportunity of multiplying the basic stake value with the aim of attaining correspondingly multiplied award values there is the problem that any multiplication applied to the bonus values would result in bonus values which are different from those printed on or alongside the bonus reel or wheel. On the other hand, if a selected multiplication of the basic stake value is not applied to bonus values this reduces the benefit to the player of the bonus in a stake-multiplied game, or at least may make it difficult for the player to compute the benefit of accepting a bonus play where this is offered as an alternative to other options.

Accordingly, the player may be confused as to the exact numerical benefits of increasing stake value and this can reduce entertainment value and act as a disincentive to such increases.

SUMMARY OF THE INVENTION

An object of the present invention is to provide a gaming machine having a bonus feature initiated by selection and display of a bonus symbol or symbols, with which the player can opt to increase stake value whereby such increase results in bonus feature enhancements which can be readily determinable by the player.

According to the invention therefore there is provided a coin-operated player-operable entertainment machine of the kind having a main display device operable, when actuated by a stake value, for play of a main game resulting in display of selected symbols at respective display positions at a win zone and wherein a bonus feature is initiated in correspondence with display of a predetermined bonus symbol or symbols at a predetermined said position or positions, and wherein said actuation of the display device can be effected by different player-selectable said stake values, characterized in that different said stake values correspond respectively to different said predetermined display positions for the bonus symbol or symbols.

With this arrangement, by changing the stake value the player can change the options for attaining the bonus feature. In particular the arrangement is preferably such that an increase in stake value results in an increase in the said predetermined display positions which correspond to initiation of the bonus feature.

This consequence in the change in the stake value can be made readily apparent to the player without necessarily requiring appreciation of any complicated numerical calculations. In simple terms, the arrangement can be such that an increase stake gives increased opportunities for attaining a bonus award. Entertainment value of the machine can therefore be enhanced and the player is encouraged to increase stake value.

The change in stake value may correspond to change in number of the predetermined bonus display positions and/or may correspond to a change in the distribution of such positions. The arrangement may be such that the bonus feature is initiated in correspondence with one said bonus symbol being displayed at one said predetermined bonus display position and/or in correspondence with a plurality of said bonus symbols being displayed at a predetermined combination of said bonus display positions.

Most preferably the arrangement is such that a multiplication of said stake value results in a related multiplication, particularly the said multiplication, of the number of said predetermined bonus display positions and/or of said predetermined combinations of said positions.

Preferably also the change in stake value results only in change in said predetermined display positions and does not, for example, result in any change in other game-playing or award features such as award value, or win zone display positions or 'pay lines' used for win assessment purposes. However, if desired these or other parameters may also change with change in stake value.

The main display device may comprise a reel display device whether using actual mechanical reels or video-simulated reels. There may be any number of reels, whether 3, 4 or 5 or otherwise, and each reel may display any number of symbols at the win zone, whether 1, 2, 3 or otherwise, and such symbols may be disposed, with the reels at rest, on one or any larger number of win lines oriented horizontally and/or vertically and/or diagonally or otherwise.

The machine may be adapted to make an award available in the event that the symbols displayed at the win zone at the end of the main game when the reels are at rest form a predetermined winning combination at a predetermined combination of positions. The award may be of a monetary nature or coins which can be paid out to the player.

The machine may also be adapted to make an award available, additionally or alternatively to any such main game award, in the event that the bonus feature is initiated and results in a successful outcome. The bonus award may be of a monetary nature or coins which can be paid out to the player.

The bonus feature may always operate to give an outcome whenever it is initiated. Alternatively, the player may have the option, e.g. by operating a control, to select or reject operation of the bonus feature. Thus, for example, the player may have the option of rejecting the bonus feature in favor of another option which may not otherwise be available.

The bonus feature may always result in an award. Alternatively the bonus feature may operate to select from a range of outcomes some of which are awards and one or more others of which may be no awards or even lost existing award value.

The bonus feature may comprise an actual or video-simulated rotatable reel having outcomes marked around its periphery, or a wheel comprising a pointer which spins around a peripheral track marked with outcomes, or otherwise.

Most preferably, the predetermined bonus display positions are indicated to the player after the stake value has been credited and before start of the main game. This may involve illumination or other highlighting or markers on or alongside the positions.

Moreover, at the end of the main game the (or each) bonus symbol at the win zone may be indicated, by presence or absence of illumination or other highlighting, as to whether it is or is not at a predetermined bonus display position. Conveniently with a video display, bonus symbols can be 'greyed out' if not at a predetermined bonus position.

DETAILED DESCRIPTION OF THE INVENTION

Figure 1:
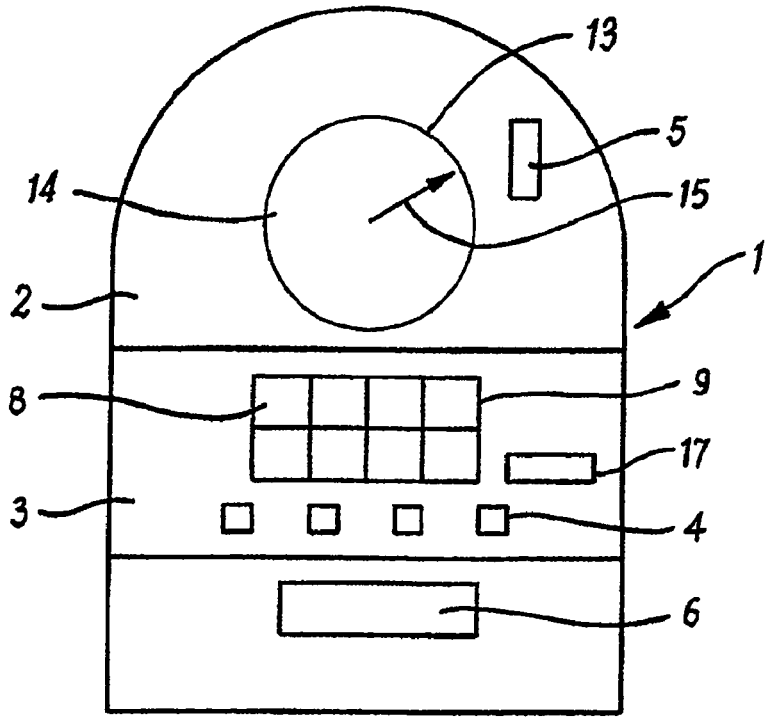
FIG. 1 is a diagrammatic front view of one form of a gaming machine according to the invention.
Figure 3:
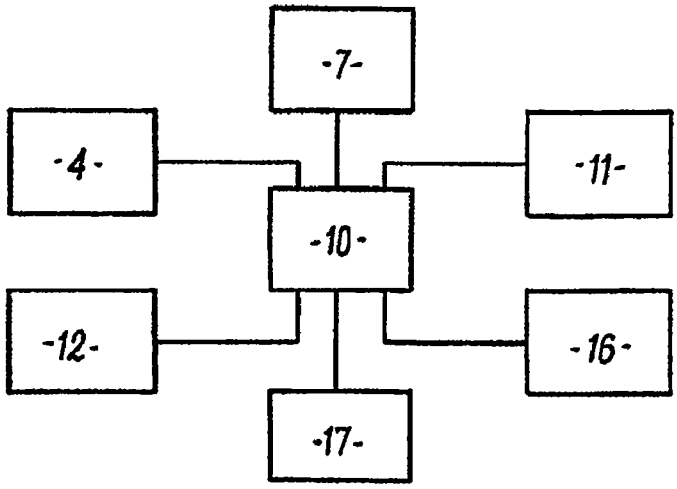
FIG. 3 is a diagrammatic block circuit diagram of the machine.

The invention will now be described further by way of example only and with reference to the accompanying drawings in which, referring to the drawings, FIG. 1 shows a gaming machine having a housing with upper and lower front panels 2, 3 operating buttons 4, a coin slot 5 and a payout opening 6.

Within the housing 1 there is a video display unit (vdu) 7, such as a crt, with a screen 8 which can be seen through a window 9 in the lower front panel 3.

The vdu 7 is connected within the housing 1 to a microprocessor-based control unit 10, as also are a coin mechanism 11, a pay out mechanism 12 and the operating buttons 4.

In the upper front panel 2 there is a bonus selector wheel or bonus wheel 13 comprising a circular display 14 having segments printed with bonus awards, some of which are monetary values, and one or more others of which are zero or lost awards. A motor-driven pointer 15 is rotatably mounted on a pivot at the centre of the circular display 14. The motor drive 16 for the pointer 15 is connected to the microprocessor-based control unit 10.

There is also an alphanumeric display or a digital display 17 on the front of the machine which is connected to the control unit 10.

In use, the player inserts coins into the coin mechanism 11 through the coin slot 5 sufficient to generate credit for play of one or more games i.e. equal to, or a multiple of, a predetermined basic stake value (say 25 cents). Total credit value is indicated on the digital display 17.

The player now selects a stake value which may be equal to or a multiple of the basic stake value and initiates play of a game with this.

This may be achieved simply by pressing a start button 4 to cause all of the available credit to be used. Alternatively the arrangement may be such that the player presses a button or buttons 4 selectively to cause a desired stake value to be taken from the available credit.

Figure 2:
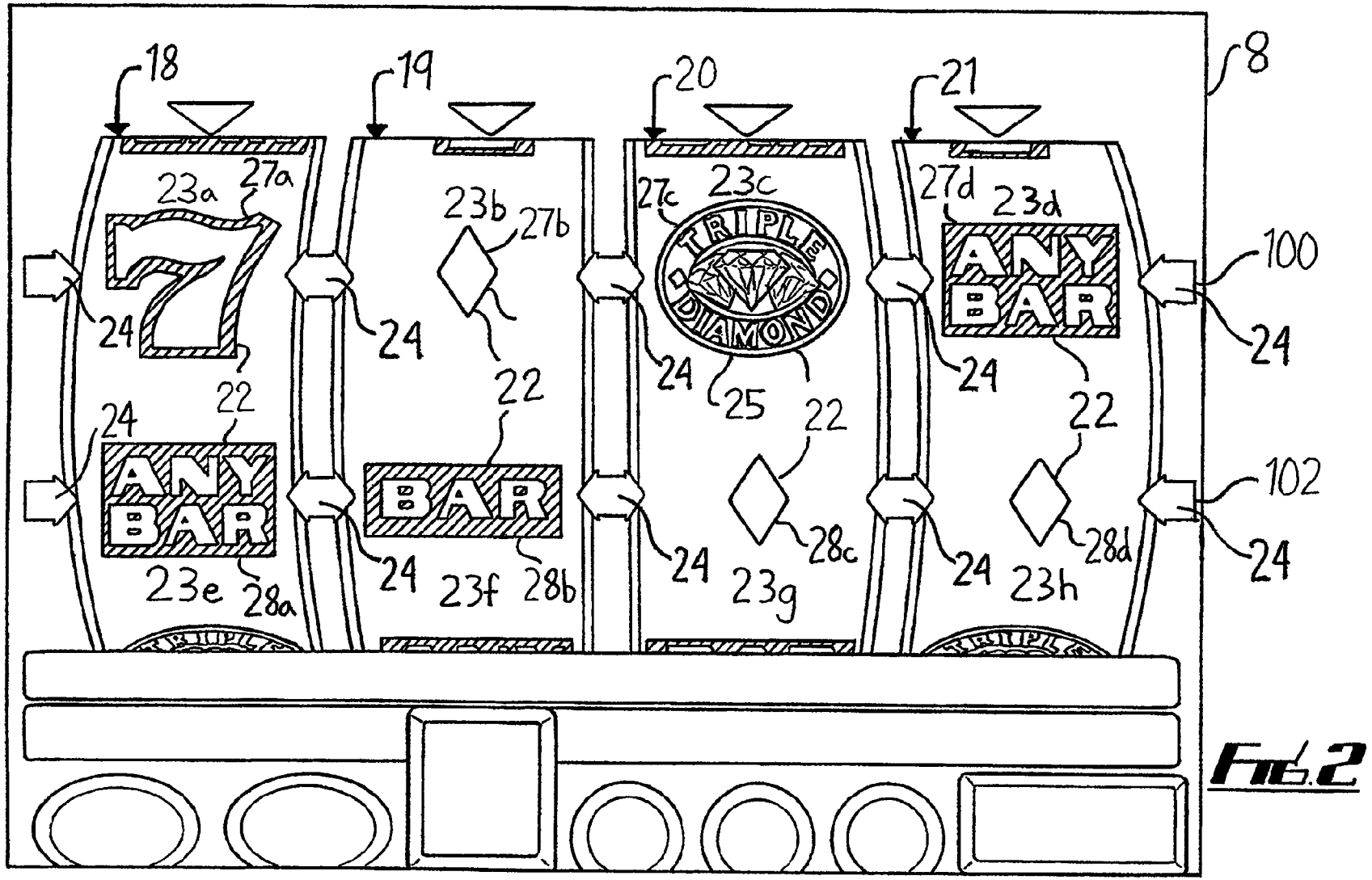
FIG. 2 is an enlarged front view of a main display device of the machine.

Referring to FIG. 2, the vdu 7 is now actuated by the control unit 10 to produce a display simulating rotation of four side-by-side reels 18, 19, 20, 21 about a common horizontal axis, each reel bearing around its periphery a predetermined sequence of say 20 or 24 equally spaced symbols 22. The vdu screen 8 shows in the window 9 moving symbols 22 for each reel 18-21, each reel 18-21 then coming to rest to show any two adjacent symbols 27*a*-27*d* and 28*a*-28*d* positioned respectively on upper horizontal win line 100 and lower horizontal win line 102 at positions 23*a*-23*h* in the window 9.

The resulting static display of eight symbols 22 (two symbols on each of four reels) is assessed by the control unit 10 and an award is made available to the player in the event that a predetermined combination of the displayed symbols 22 is of a predetermined winning nature. The static display is derived in correspondence with random selection of symbol data from sequences of such data stored in memory of the control unit 10, and win assessment is applied to such randomly selected data.

A single predetermined combination may be used for win assessment purposes e.g. the four symbols on the upper or lower horizontal win lines. However other predetermined combinations may be used.

Some of the symbols 22 are special bonus symbols, such as, for example, bonus symbol 25. When such symbol or symbols are displayed, when the reels 18-21 come to rest, at a predetermined one or ones of the positions 23 in the window 9, play can now progress to the bonus wheel 13. The pointer 15 is now rotated and then comes to rest at random indicating one of the printed bonus awards which, as appropriate, is then made available to the player. Rotation of the pointer 15 may be initiated automatically or after operation of one of the buttons 4.

With regard to the position or positions 23 which are used for bonus assessment, these are predetermined in correspondence with the stake value (multiple of basic stake) selected by the player at the start of the game.

In the case where the player selects only the basic stake value (25 cents), the bonus wheel 13 comes into play only if the bonus symbol, which in this example is bonus symbol 25, is displayed at the first bonus position 23*a* (extreme left in FIG. 2) on the top win line 100.

If the player selects 50c 75c or $1 the bonus wheel 13 can come into play if the bonus symbol is on respectively the first two, first three or all four positions 23 on the top win line.

If the player selects $1.25, $1.50, $1.75 or $2.00, the bonus wheel can come into play if the bonus symbol is on any of the top win line positions or respectively the first one, first two, first three or all four positions of the bottom win line 102.

Thus, by increasing the level of stake value the player can increase the likelihood of attaining a bonus play. The increase in likelihood is directly proportional to the increase in stake value whereby for example an 8 times increase in stake value results in an 8 times increases in bonus play likelihood due to increase in predetermined bonus positions from one to eight.

The predetermined bonus positions can be indicated to the player in any suitable way. For example there may be indicators 24 adjacent to the symbol positions 23 which illuminate when they have been selected as predetermined bonus positions.

Also, when a bonus symbol is displayed on a selected predetermined bonus position the symbol may be illuminated or highlighted, whereas bonus symbols displayed on other positions 23 may be 'greyed-out' or otherwise indicated to be inactive.

With this arrangement, the player has an incentive to increase the stake value since any such increase correspondingly increases the likelihood of attaining a bonus play, and the player can readily determine and appreciate this. This gives rise to enhanced entertainment value as well as encouraging increase in stake value.

It is of course to be understood that the invention is not intended to be restricted to the details of the above embodiment which are described by way of example only.

Thus, for example, the display may involve any number of reels and any number of symbols displayed in the window for each reel. Moreover, the reel display need not be a simulated video display but may instead involve the use of actual mechanical reels. Further, instead of, or additionally to, making bonus play available in correspondence with display of a bonus symbol at a predetermined position, bonus play may arise in correspondence with display of a predetermined combination of bonus symbols at a predetermined combination of positions.

Where bonus play becomes available as a consequence of a plurality of events each of which alone would be sufficient for bonus play (e.g. where multiple bonus symbols are displayed respectively at multiple selected predetermined bonus positions), the duplication may be ignored such that only one bonus play is made available, or if desired the arrangement may be such that multiple bonus plays are made available.

With the embodiment described, multiplication of the basic stake results in increase in bonus play likelihood without any multiplication of award values. However, other arrangements possibly involving award value multiplication may also be used.

The invention is hereby claimed as follows:

1. A gaming machine comprising:

a cabinet;

at least one display device supported by the cabinet;

a memory device;

an input device operable by a player; and a control unit, in communication with the memory device and input device, the control unit configured to operate with the at least one display device to:

(a) display a plurality of reels associated with a main game, each one of the reels having a plurality of symbols which are displayable at a plurality of symbol display areas, each one of the symbol display areas being designatable as a bonus evaluation area, the plurality of symbols including a plurality of bonus symbols, the plurality of symbols being combinable to form a plurality of different symbol combinations displayable on the reels, the symbol combinations including at least one winning combination;

(b) access wager data stored in the memory device, the wager data corresponding to a plurality of wager levels including a first wager level and a greater, second wager level, each one of the wager levels being sufficient for starting a play of the main game;

(c) receive a wager input signal, the wager input signal corresponding to a wager received from the player to start the play of the main game;

(d) designate for said play of the main game a quantity of one or more win zones associated with a plurality of the symbol display areas, wherein the quantity of win zones designated for said play of the main game is independent of whether the received wager is at the first or second wager level;

(e) display an indication of said designated win zones for said play of the main game;

(f) if the received wager is at the first wager level, randomly select a first quantity of the plurality of symbol display areas to designate as bonus evaluation areas for said play of the main game, the first quantity being at least one, wherein which of said plurality of symbol display areas are selected to be designated as bonus evaluation areas is determined independent of the symbol display areas associated with any designated win zones;

(g) if the received wager is at the second wager level, randomly select a second quantity of the plurality of symbol display areas to designate as bonus evaluation areas for said play of the main game, the second quantity being greater than the first quantity, wherein which of said plurality of symbol display areas are selected to be designated as bonus evaluation areas is determined independent of the symbol display areas associated with any designated win zones;

(h) randomly generate a plurality of the symbols of the reels for said play of the main game;

(i) display the randomly generated symbols at a plurality of the symbol display areas, including any of the bonus evaluation areas;

(j) perform a first evaluation to determine whether the symbols displayed in any of said designated win zones form the at least one winning combination, the at least one winning combination having a winning combination probability of occurrence;

(k) provide a main game award in response to the occurrence of the at least one winning combination;

(l) perform a second evaluation to determine whether any bonus symbols are displayed at any of the bonus evaluation areas;

(m) if at least one bonus symbol is displayed at at least one of said designated bonus evaluation areas, start a bonus game, the bonus game having a probability of occurrence which is:

(1) independent of the winning combination probability; and (2) dependent upon the quantity of symbol display areas which are randomly selected to be designated as bonus evaluation areas for said play of the main game; and (n) provide a bonus award as a result of a winning bonus outcome occurring in the bonus game.

2. The gaming machine of claim 1, wherein each one of the win zones corresponds to a pay line.

3. The gaming machine of claim 1, wherein the memory device stores data associated with at least one bonus start condition, the bonus start condition being selected from the group consisting of: (a) a bonus start condition requiring a designated combination of the bonus symbols to be displayed at the bonus evaluation areas of a plurality of the reels; and (b) a bonus start condition requiring at least one of the bonus symbols to be displayed at one of the bonus evaluation areas of at least one of the reels.

4. The gaming machine of claim 1, wherein each of the first and second wager levels is associated with a designated quantity of bonus start conditions and the second wager level is associated with a higher quantity of bonus start conditions.

5. The gaming machine of claim 1, wherein the reels include a reel selected from the group consisting of a mechanical reel and a video-simulated reel.

6. The gaming machine of claim 1, wherein the main game award and the bonus award are each associated with a payout.

7. The gaming machine of claim 1, which includes an indicator displayed by the at least one display device, wherein, after the player inputs the desired wager level and before the play of the main game, the indicator indicates information to the player related to one or more bonus start conditions.

8. A gaming machine comprising:

a cabinet;

at least one display device supported by the cabinet;

a memory device;

an input device operable by a player; and a control unit, in communication with the memory device and input device, the control unit configured to operate with the at least one display device to:

(a) display a plurality of reels associated with a main game, each one of the reels having a plurality of symbols which are displayable at a plurality of symbol display areas, each one of the symbol display areas being designatable as a bonus evaluation area, the plurality of symbols including a plurality of bonus symbols, the plurality of symbols being combinable to form a plurality of different symbol combinations displayable on the reels, the symbol combinations including at least one winning combination;

(b) access wager data stored in the memory device, the wager data corresponding to a plurality of wager levels including a first wager level and a greater, second wager level, each one of the wager levels being sufficient for starting a play of the main game;

(c) receive a wager input signal, the wager input signal corresponding to a wager received from the player to start the play of the main game;

(d) receive a pay line input from the player, the pay line input corresponding to a selected quantity of one or more pay lines, each of said pay lines associated with a plurality of the symbol display areas, the quantity of pay lines being selectable independent of whether the received wager is at the first or second wager level;

(e) if the received wager is at the first wager level, randomly select a first quantity of the plurality of symbol display areas to designate as bonus evaluation areas for said play of the main game, the first quantity being at least one, wherein which of said plurality of symbol display areas are selected to be designated as bonus evaluation areas is determined independent of the symbol display areas associated with the selected quantity of pay lines for said play of the main game;

(f) if the received wager is at the second wager level, randomly select a second quantity of the plurality of symbol display areas to designate as bonus evaluation areas for said play of the main game, the second quantity being greater than the first quantity, wherein which of said plurality of symbol display areas are selected to be designated as bonus evaluation areas is determined independent of the symbol display areas associated with the selected quantity of pay lines for said play of the main game;

(g) randomly generate a plurality of the symbols of the reels for said play of the main game;

(h) display the randomly generated symbols at a plurality of the symbol display areas, including any of the bonus evaluation areas;

(i) perform a first evaluation to determine whether the symbols displayed on any of the selected quantity of pay lines form the at least one winning combination, the at least one winning combination having a winning combination probability of occurrence;

(j) provide a main game award in response to the occurrence of the at least one winning combination;

(k) perform a second evaluation to determine whether any bonus symbols are displayed at any of the bonus evaluation areas;

(l) if at least one bonus symbol is displayed at at least one of said bonus evaluation areas, start a bonus game, the starting of the bonus game having a probability of occurrence which is:

(1) independent of the winning combination probability; and (2) dependent upon the quantity of symbol display areas which are randomly selected to be designated as bonus evaluation areas for said play of the main game; and (m) provide a bonus award as a result of a winning bonus outcome occurring in the bonus game.

9. The gaming machine of claim 8, wherein a plurality of the symbol display areas associated with the selected quantity of pay lines are designatable as bonus evaluation areas.

10. The gaming machine of claim 8, wherein the control unit is configured to operate with the at least one display device to produce a graphical indication of each one of the bonus evaluation areas.

11. The gaming machine of claim 10, wherein the control unit is configured to operate with the at least one display device to produce a different graphical indication at any one of the bonus evaluation areas which displays one of the bonus symbols.

12. The gaming machine of claim 8, wherein the reels include a reel selected from the group consisting of a mechanical reel and a video-simulated reel.

13. The gaming machine of claim 8, wherein the main game award and the bonus award are each associated with a payout.

14. The gaming machine of claim 8, wherein the first and second wager levels include a plurality of different levels of stake values.

15. A method for operating a gaming machine, the method comprising:

causing a control unit to operate with an input device and a display device to:

(a) display a plurality of reels associated with a main game, each one of the reels having a plurality of symbols which are displayable at a plurality of symbol display areas, each one of the symbol display areas being designatable as a bonus evaluation area, the plurality of symbols including a plurality of bonus symbols, the plurality of symbols being combinable to form a plurality of different symbol combinations displayable on the reels, the symbol combinations including at least one winning combination;

(b) access wager data stored in the memory device, the wager data corresponding to a plurality of wager levels including a first wager level and a greater, second wager level, each one of the wager levels being sufficient for starting a play of the main game;

(c) receive a wager input signal, the wager input signal corresponding to a wager received from the player to start the play of the main game;

(d) designate for said play of the main game a quantity of one or more win zones associated with a plurality of the symbol display areas, the quantity of win zones being independent of whether the received wager is at the first or second wager level:

(e) display an indication of said designated win zones for said play of the main game;

(f) if the received wager is at the first wager level, randomly selecting a first quantity of the plurality of symbol display areas to designate as bonus evaluation areas for said play of the main game, the first quantity being at least one, wherein which of said plurality of symbol display areas are selected to be designated as bonus evaluation areas is determined independent of the symbol display areas associated with any designated win zones;

(g) if the received wager is at the second wager level, randomly selecting a second quantity of the symbol display areas to designate as bonus evaluation areas for said play of the main game, the second quantity being greater than the first quantity, wherein which of said plurality of symbol display areas are selected to be designated as bonus evaluation areas is determined independent of the symbol display areas associated with any designated win zones;

(h) randomly generate a plurality of the symbols for play of the main game;

(i) display the randomly generated symbols at a plurality of the symbol display areas, including any of the bonus evaluation areas;

(j) perform a first evaluation to determine whether the symbols displayed in any of the designated quantity of win zones form the at least one winning combination, the at least one winning combination having a winning combination probability of occurrence;

(k) provide a main game award in response to the occurrence of the at least one winning combination;

(k) perform a second evaluation to determine whether any bonus symbols are displayed at any of the bonus evaluation areas;

(l) if at least one bonus symbol is displayed at at least one of said bonus evaluation areas, start a bonus game, the starting of the bonus game having a probability of occurrence which is:

(1) independent of the winning combination probability; and (2) dependent upon the quantity of symbol display areas which are randomly selected to be designated as the bonus evaluation areas for said play of the main game; and (m) provide a bonus award as a result of a winning bonus outcome occurring in the bonus game.

16. The method of claim 15, wherein the plurality of selectable win zones include a plurality of selectable pay lines.

17. The method of claim 15, which includes providing a plurality of different bonus start conditions selected from the group consisting of: (a) a bonus start condition requiring a display of a designated combination of the bonus symbols at the bonus evaluation areas of a plurality of the reels; and (b) a bonus start condition requiring a display of at least one of the bonus symbols at one of the bonus evaluation areas of at least one of the reels.

18. The method of claim 15, which includes: (a) associating each of the first and second wager levels with a designated quantity of bonus start conditions and (b) associating the second wager level with a higher quantity of the bonus start conditions.

19. The method of claim 15, which includes providing a payout based on any provided main game award and any provided bonus award.

20. The method of claim 15, which includes indicating information after the player inputs the wager and before a play of the main game, the information relating to one or more bonus start conditions.

21. A method for operating a gaming machine, the method comprising:

causing a control unit to operate with an input device and a display device to:

(a) display a plurality of reels associated with a main game, each one of the reels having a plurality of symbols which are displayable at a plurality of symbol display areas, each one of the symbol display areas being designatable as a bonus evaluation area, the plurality of symbols including a plurality of bonus symbols, the plurality of symbols being combinable to form a plurality of different symbol combinations displayable on the reels, the symbol combinations including at least one winning combination;

(b) access wager data stored in the memory device, the wager data corresponding to a plurality of wager levels including a first wager level and a greater, second wager level, each one of the wager levels being sufficient for starting a play of the main game;

(c) receive a wager input signal, the wager input signal corresponding to a wager received from the player to start the play of the main game;

(d) receive a pay line input from the player, the pay line input corresponding to a selected quantity of one or more pay lines, each of said pay lines associated with a plurality of the symbol display areas, the quantity of pay lines being selectable independent of whether the received wager is at the first or second wager level;

(e) if the received wager is at the first wager level, randomly selecting a first quantity of the symbol display areas to designate as bonus evaluation areas for said play of the game, the first quantity being at least one, wherein which of said plurality of symbol display areas are selected to be designated as bonus evaluation areas is determined independent of the symbol display areas associated with the selected quantity of a lines for said play of the main game;

(f) if the received wager is at the second wager level, randomly selecting a second quantity of the symbol display areas to designate as bonus evaluation areas for said play of the main game, the second quantity being greater than the first quantity, wherein which of said plurality of symbol display areas are selected to be designated as bonus evaluation areas is determined independent of the symbol display areas associated with the selected quantity of pay lines for said play of the main game; first or second wager level;

(g) randomly generate a plurality of the symbols for play of the main game;

(h) display the randomly generated symbols at a plurality of the symbol display areas, including any of the bonus evaluation areas;

(i) perform a first evaluation to determine whether the symbols displayed on any of the selected quantity of pay lines form the at least one winning combination, the at least one winning combination having a winning combination probability of occurrence;

(j) provide a main game award in response to the occurrence of the at least one winning combination;

(k) perform a second evaluation to determine whether any bonus symbols are displayed at any of the bonus evaluation areas;

(l) if at least one bonus symbols is displayed at at least one of the bonus evaluation areas, start a bonus game, the starting of the bonus game having a probability of occurrence which is:

(1) independent of the winning combination probability; and (2) dependent upon the quantity of the symbol display areas which are randomly selected to be designated as bonus evaluation areas for said play of the main game; and (m) provide a bonus award as a result of a winning bonus outcome occurring in the bonus game.

22. The method of claim 21, wherein a plurality of the symbol display areas associated with the selected quantity of pay lines are designatable as bonus evaluation areas.

23. The method of claim 21, which includes causing the control unit to operate with the display device to produce a graphical indication of each one of the bonus evaluation areas.

24. The method of claim 21, which includes causing the control unit to operate with the display device to produce a different graphical indication at any one of the bonus evaluation areas which displays one of the bonus symbols.

25. The method of claim 21, which includes associating the main game award and the bonus award with a payout.

26. The method of claim 21, which, includes associating the plurality of the first and second wager levels with a plurality of different levels of stake values.

* * * * *

UNITED STATES PATENT AND TRADEMARK OFFICE

CERTIFICATE OF CORRECTION

PATENT NO. : 7,699,698 B2
APPLICATION NO. : 10/861084
DATED : April 20, 2010
INVENTOR(S) : Dov Liam Randall It is certified that error appears in the above-identified patent and that said Letters Patent is hereby corrected as shown below:

IN THE CLAIMS:

In Claim 21, Column 11, Line 54, replace "a lines" with --pay lines--.

In Claim 21, Column 12, line 10, delete "first or second wager level;".

Signed and Sealed this

Twenty-ninth Day of June, 2010

David J. Kappos

David J. Kappos
*Director of the United States Patent and Trademark Office*